United States Patent [19]

Schäfer et al.

[11] Patent Number: 5,025,971

[45] Date of Patent: Jun. 25, 1991

[54] ANNULAR CUSHIONING BUFFER FOR FASTENER-DRIVING TOOLS

[75] Inventors: Manfred Schäfer, Bad Homburg; Kurt Schumann, Wiesbaden-Naurod; Horst Tacke, Bad Vilbel, all of Fed. Rep. of Germany

[73] Assignee: Paslode GmbH, Eschborn-Niederhochstadt, Fed. Rep. of Germany

[21] Appl. No.: 408,360

[22] Filed: Sep. 18, 1989

[30] Foreign Application Priority Data

Sep. 20, 1988 [DE] Fed. Rep. of Germany ..... 3831864

[51] Int. Cl.[5] ..... B25C 1/04

[52] U.S. Cl. ..... 227/156; 227/130

[58] Field of Search ..... 227/156, 130

[56] References Cited

U.S. PATENT DOCUMENTS 4,932,480 6/1990 Golsch ..... 227/156 X

FOREIGN PATENT DOCUMENTS 0001469 4/1979 European Pat. Off. .
1808530 7/1969 Fed. Rep. of Germany .
2510858 1/1987 Fed. Rep. of Germany .

*Primary Examiner*—Paul A. Bell
*Attorney, Agent, or Firm*—Schwartz & Weinrieb

[57] ABSTRACT

An annular cushioning buffer (1) is fabricated from an elastic material, such as, for example, polyurethane, for use in connection with fastener-driving tools for impact load distribution and energy absorption purposes. The buffer (1) includes an axially central passage (2) having an axis (M), as well as a plurality of axially extending holes (3) equiangularly spaced about the annular buffer (1) along a circular locus thereof. Radially extending slots (6) extend toward and open onto or pierce inner and outer peripheral or circumferential surfaces (4,5) of the buffer (1) in an alternative fashion so as to uniformly distribute the load impressed upon the buffer (1) by means of the striking piston of the fastener-driving tool.

20 Claims, 1 Drawing Sheet

ANNULAR CUSHIONING BUFFER FOR FASTENER-DRIVING TOOLS

FIELD OF THE INVENTION

The present invention relates generally to cushioning buffers, and more particularly to an annular cushioning buffer, fabricated from a suitable elastic material, for use in connection with fastener-driving tools and having a central passage, defined therethrough in the axial direction thereof, as well as a plurality of axially extending holes arranged upon a circular locus about the axis thereof, and wherein further, the buffer has a circular cross-section when taken within or along a plane transverse or perpendicular to the axis thereof.

BACKGROUND OF THE INVENTION

Cushioning buffers are conventionally used in connection with pneumatically actuated fastener-driving machinery or tools, such as, for example, nail drivers, so as to cushion the striking piston of the driving tool as well as to simultaneously reduce the sound or noise accompanying the impulse or impact generated by means of the tool during each working cycle.

Conventional cushioning buffers, such as, for example, those of the type disclosed within German Patent DE 25 10 858 C2, the destruction or absorption of energy is effected or achieved as a result of the compression of the volumetric extent of the cushioning buffer in the axial direction thereof. Because of material fatigue, however, this energy dissipating process has a significant detrimental effect upon the service life of the cushioning buffer.

OBJECT OF THE INVENTION

Accordingly, it is an object of the present invention to provide a new and improved cushioning buffer of the aforenoted type and for the aforenoted uses wherein the new and improved cushioning buffer of the present invention will exhibit a greater service life than that of conventional cushioning buffers.

SUMMARY OF THE INVENTION

In accordance with the present invention, the foregoing and other objectives are achieved by means of the new and improved cushioning buffer of the present invention wherein there is provided an annular cushioning buffer, and wherein further, there is provided at least one axially extending slot which extends in the axial direction along an inner circumferential wall portion of the annular buffer or along an outer circumferential wall portion of the annular buffer, and wherein further, the slot extends radially from a hole, extending axially through the buffer and defined at a radial extent which is intermediate the inner and outer circumferential wall portions of the buffer, toward either one of the inner and outer circumferential wall portions of the annular buffer. In the preferred embodiment of the present invention, a plurality of holes are defined along a circular locus within the annular buffer, and a plurality of slots are respectively associated with each hole so as to alternately extend radially inwardly or radially outwardly toward the inner and outer circumferential wall portions of the buffer.

As a result of the provision of the plurality of slots defined within the buffer, a yielding phenomenon or movement of the elastic material comprising the buffer occurs upon axial loading of the cushioning buffer by means of the striking piston of the fastener-driving tool, which action or movement leads to a surprising increase in the service life of the cushioning buffer.

As has been noted hereinabove, in accordance with a preferred embodiment of the present invention, the slots extend alternately in the radially inwardly and radially outwardly direction toward the inner and outer circumferential wall portions or surfaces of the buffer, and as a result of such structure, uniform loading of the cushioning buffer is achieved.

In order to simplify fabrication of the cushioning buffer, and in addition, in order to readily provide the radially extending slots therein, as well as to provide the necessary yieldability and resiliency of the elastic material comprising the buffer, whereby the extension or increase in the service life of the buffer will be able to be achieved, it is additionally preferred that the slots actually open into, extend through, or pierce the inner and outer circumferential wall portions or surfaces of the buffer.

With respect to the operational function of the cushioning buffer of the present invention, as well as with respect to the manufacturing techniques thereof, it is additionally advantageous for the slots to have an axial extent which is substantially the same as those of the holes of the buffer so as to provide the cushioning buffer with excellent flexibility.

It is further noted that in order to insure the fact that the elastic material comprising the buffer is uniformly stressed or loaded upon axial loading thereof by means of the striking piston of the fastener-driving tool, the slots of the buffer are provided or defined within the buffer so as to extend radially or substantially radially.

In addition, it is further noted that in order to similarly achieve or insure achievement of the aforenoted objectives of uniform stress or loading of the buffer, it is additionally preferred that the plurality of holes defined within and extending through the buffer are equiangularly spaced along the circular locus thereof.

It is further noted that the ratio of the diameter of each hole with respect to the width of each slot operatively associated therewith is approximately 2:1 such that the cushioning buffer of the present invention advantageously exhibits sufficient stability.

It is additionally noted that the holes operatively associated with the slots which open into or pierce the inner circumferential wall portion or surface of the buffer are additionally provided with recesses defined within the radially outer upper surface regions of the buffer. These structural features facilitate the manufacture or provision of the holes with the associated slots within the buffer.

In order to facilitate the entry and penetration of the tapered shoulder portion of the striking piston of the fastener-driving tool into the axially central passage of the cushioning buffer, the upper radially inner peripheral edge portion of the buffer, defining the axially central passage thereof, is rounded off or chamfered. The upper surface region of the elastic material is thus easily or readily spreadible as a result of the provision of the radial slots.

It is still yet further noted that it is particularly advantageous for the impact and/or contact surfaces of the buffer to be flat or planar, to be disposed parallel with respect to each other, and to be perpendicular to the longitudinal or central axis of the buffer in order to additionally insure the fact that uniform loading of the cushioning buffer is achieved or produced upon impact of the striking piston of the driving tool upon the cushioning buffer.

At the upper end of each of the slots which are open toward the axially central passage of the buffer or in other words, which pierce the inner peripheral or circumferential surface of the buffer, the slots likewise pierce or extend radially through the impact surface regions of the buffer, and they similarly extend radially through o pierce the contact surface regions of the buffer at their lower ends. The upper ends of each slot which is open to or pierces the outer peripheral or circumferential surface of the buffer only extend up to their respective associated axially extending holes which are disposed upon the circular locus which is located immediately radially outwardly to the impact surface of the buffer, while the lower ends of such slots, opening outwardly to or extending through the outer peripheral or circumferential surface of the buffer, extend radially inwardly from such outer peripheral or circumferential surface of the buffer and through the radially outermost portion of the contact surface of the buffer so as to similarly terminate at the locus of each one of the respective axially extending holes.

It is further noted that since, upon impact of the striking piston of the fastener-driving tool upon the upper impact surface of the buffer, the upper impact surface or region of the buffer is initially strongly loaded, and the buffer must be able to accommodate such loading and stress and be able to uniformly radially expand or yield so as to consistently and repetitively absorb or dissipate such impact loads, stress, and energy. Accordingly, the upper region of the cushioning buffer is curved in a radially outwardly or convex manner within the vicinity of the impact surface such that the diametrical extent of the lower contact surface is greater than the diametrical extent of the upper impact surface.

An additional feature of the present invention cushioning buffer is the provision of a radially outwardly expanded offset peripheral or circumferential portion within the lower region of the outer peripheral or circumferential surface thereof. In this manner, the buffer can be readily fixed within the cylinder of the fastener-driving tool without adversely affecting, or alternatively, permitting, the possibility of radially outwardly expansion of those portions of the elastic buffer disposed axially above the offset region.

The cushioning buffer of the present invention is preferably fabricated from polyurethane in view of the fact that such material exhibits satisfactory results with respect to energy dissipation or absorption, durability, and elasticity.

BRIEF DESCRIPTION OF THE DRAWINGS

Various other objects, features, and attendant advantages of the present invention will become better understood from the following detailed description, when considered in connection with the accompanying drawings, in which like reference characters designate like or corresponding parts throughout the several views, and wherein.

DETAILED DESCRIPTION OF THE PREFERRED EMBODIMENT

Figure 1:
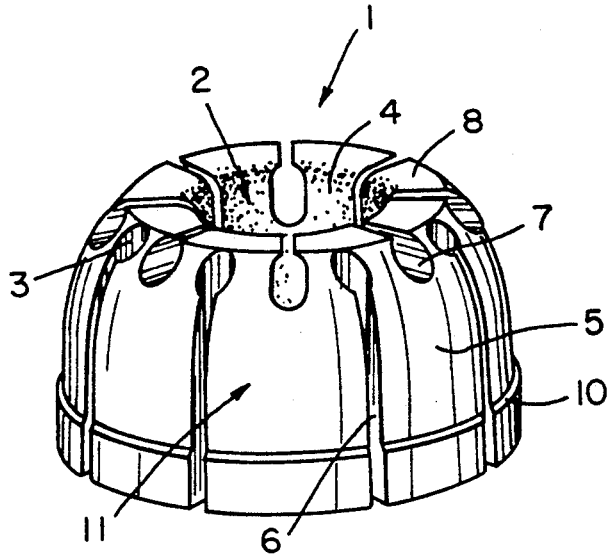
FIG. 1 is a perspective view of the new and improved cushioning buffer constructed in accordance with the present invention.
Figure 3:
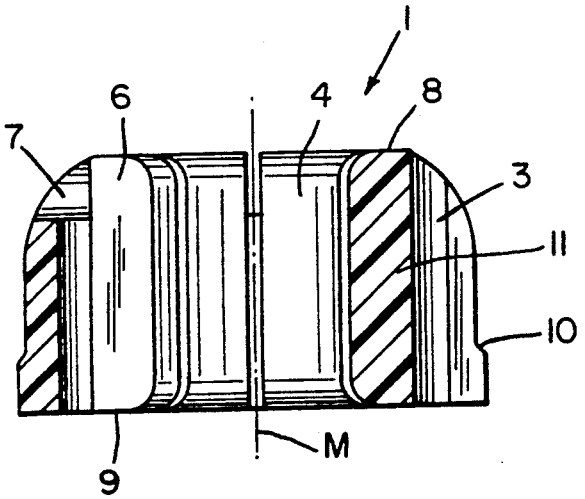
FIG. 3 is a cross-sectional view of the cushioning buffer of FIG. 2 taken along the lines 3—3 of FIG. 2.
Figure 2:
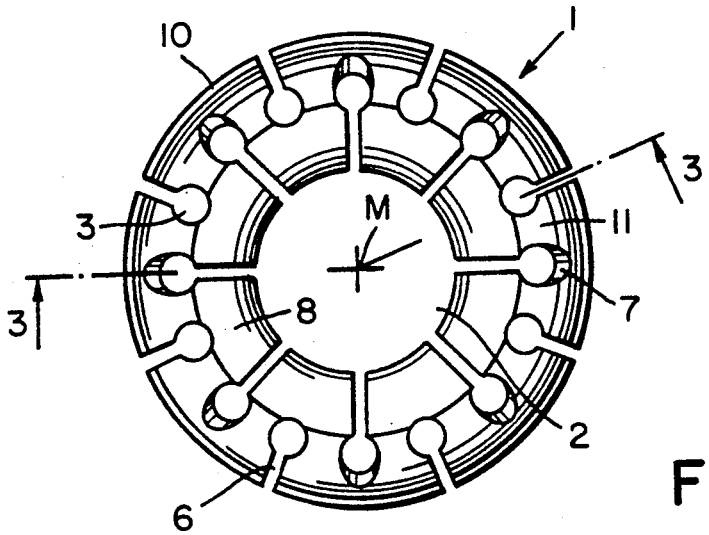
FIG. 2 is a plan view of the cushioning buffer illustrated in FIG. 1.

Referring now to the drawings, it is seen that the new and improved cushioning buffer of the present invention, which is generally indicated by the reference character 1, and which is preferably fabricated from a suitable elastic material, such as, for example, polyurethane, is seen to have a substantially annular form with a central axial passage 2 defined therethrough. Within its annular body 11 there is provided a plurality of axially extending holes 3, each of which has a circular cross-section, and it is also seen that the holes 3 are located upon a circular locus. The annular buffer 1 is seen to further include an inner peripheral or circumferential surface 4 and an outer peripheral or circumferential surface 5. Radially extending slots 6 are in communication with each one of the holes 3, and it is seen that alternate ones of the slots 6 extend toward and open onto or pierce the inner and outer peripheral or circumferential surfaces 4 and 5. The ratio of the diameter of each hole 3 with respect to the width of each slot 6 is approximately 2:1. The upper surface of the buffer is substantially flat so as to define an impact surface 8 upon which the striking piston of the fastener-driving tool impacts or loads the buffer and the bottom surface of the buffer is likewise substantially flat so as to define a contact surface 9. The impact and contact surfaces 8 and 9 are therefore seen to be substantially parallel to each other and perpendicular to the axis M of the buffer, and it is further appreciated that the axial length of slots 6 is substantially the same as that of each hole 3 so as to extend between the impact and contact surfaces 8 and 9. As best seen in FIG. 3, radially extending recesses or holes 7 are provided within the uppermost regions of outer peripheral or circumferential surface 5 so as to be open to or in communication with axially extending holes 3 and those slots 6 which open into o pierce only the inner peripheral or circumferential surface 4.

It is further noted that each of the holes 3 and the slots 6 are equiangularly spaced about the buffer axis M, and that the upper and lower peripheral or circumferential edges of central passage 2 are rounded or chamfered. The slots 6, which open into the central passage 2 or extend through the inner peripheral or circumferential surface 4, also extend entirely through the impact surface 8, however, this is not the case with respect to the lower contact surface 9 in view of the additional fact that the radial or diametrical extent of lower contact surface 9 is larger than that of the impact surface 8. It is accordingly further appreciated that in order to provide for a smooth transition between contact surface 9 and impact surface 8, as well as to provide the buffer with the proper or requisite energy or force load absorption and distribution properties, the upper region of the outer or external peripheral or circumferential surface 5, within the vicinity of the impact surface 8, is convexly curved, and it is additionally seen that the slots 6 which open onto or pierce outer peripheral or circumferential surface 5 likewise open onto or pierce this upper convex region of surface 5 at the upper ends thereof. It is lastly noted that the cushioning buffer of the present invention also includes a radially enlarged offset region 10 which extends around the entire outer periphery of the buffer 1 at the lower end thereof. This structural feature permits the buffer to be properly disposed and oriented within the cylinder of the fastener-driving tool without adversely affecting or interfering with any radial expansion of the upper portion of the buffer when the same is subjected to the impact forces of the striking piston of the fastener-driving tool.

As has been noted hereinabove, the provision of the radially extending slots within the buffer of the present invention provides the same with a predetermined amount of yieldability and elastic deformation upon being subjected to the axial loading thereof by means of the striking piston of the fastening driving tool whereby, in turn, an increased service life is achieved. The alternately directed slots, that is, slots directed toward or extending through, the inner and outer peripheral or circumferential surfaces of the annular buffer further provide uniform load distribution properties to the buffer. In addition, the provision of such slots having an axial length extending substantially between the upper and lower impact and contact surfaces further provides the buffer with a requisite amount of flexibility and axial compression with concomitant radial expansion under such load conditions.

Obviously, many modifications and variations of the present invention ar possible in light of the above teachings. For example, while the preferred embodiment of the cushioning buffer of the present invention is illustrated in the drawings as including sixteen holes 3 and slots 6 associated therewith, with an angular spacing between each hole 3 or each slot 6 of 22.5°, obviously, this precise number of holes and slots may vary. It is therefore to be understood that within the scope of the appended claims, the present invention may be practiced otherwise than as specifically described herein.

We claim:

1. An annular cushioning buffer (1), comprising:

an annular body (11) having an axial passage (2) defined therethrough with an axis (M);

a plurality of axially extending holes (3) defined within said annular body (11) and arranged upon a circular locus about said axis (M);

said annular body (11) having an inner peripheral surface (4) and an outer peripheral surface (5); and a plurality of slots (6) extending from said holes (3) toward said inner peripheral surface (4) and said outer peripheral surface (5).

2. Cushioning buffer (1) according to claim 1, characterized in that the slots run alternately in the direction of the inner surface (4) or the outer surface (5) of the body.

3. Cushioning buffer (1) according to claim 1, characterized in that the slots (6) open onto the inner surface (4) or the outer surface (5) of the body.

4. Cushioning buffer (1) according to claim 3, characterized in that the holes (3) furnished with slots (6) opening onto the inner surface (4) of the body open out into recesses (7) opening onto an upper region of the outer surface (5) of the body.

5. Cushioning buffer (1) according to claim 1, characterized in that the slots (6) extend over substantially the entire axial length of the holes (3).

6. Cushioning buffer (1) according to claim 1, characterized in that the slots (6) extend substantially radially.

7. Cushioning buffer (1) according to claim 1, characterized in that the holes (3) are equiangularly spaced upon said circular locus about said axis (M).

8. A cushioning buffer (1) as set forth in claim 7, wherein said holes (3) are angularly spaced from each other by means of an angular extent of 22.5°.

9. Cushioning buffer (1) according to claim 1, characterized in that the ratio of the diameter of each hole (3) to the width of each slot (6) is approximately 2:1.

10. Cushioning buffer (1) according to claim 1, characterized in that upper and lower inner edge regions of the passage (2) are rounded off.

11. Cushioning buffer (1) according to claim 1, wherein said body (11) includes an impact surface (8) and a contact surface (9), and characterized in that the impact surface (8) and the contact surface (9) are flat and run parallel to one another and are perpendicular to the central axis (M).

12. Cushioning buffer (1) according to claim 4, characterized in that upper ends of the slots (6) opening onto the inner surface (4) of the body open out onto the impact surface.

13. Cushioning buffer (1) according to claim 4, characterized in that the impact surface (8) is smaller than the contact surface (9) in diametrical extent.

14. Cushioning buffer (1) according to claim 11, characterized in that the outer surface (5) of the body is convexly curved in the region adjacent to the impact surface (8).

15. Cushioning buffer (1) according to claim 14, characterized in that upper ends of the slots (6) opening onto the outer surface (5) of the body open out onto the convexly curved region of the outer surface (5) of the body.

16. Cushioning buffer (1) according to claim 1, characterized in that the outer surface (5) of the body has an offset (10) in the lower region.

17. Cushioning buffer (1) according to claim 1, characterized in that said annular body (11) comprises polyurethane, preferably in one piece.

18. A cushioning buffer as set forth in claim 1, wherein:

said plurality of holes comprises sixteen holes.

19. A cushioning buffer (1) as set forth in claim 1, wherein:

said annular body (11) comprises an elastic material.

20. A cushioning buffer as set forth in claim 1, wherein:

each of said holes (3) has a circular cross-section.

* * * * *